350-1.7 SR
7/10/79 XR 4,160,929

United States Patent [19] [11] 4,160,929
Thorington et al. [45] Jul. 10, 1979

[54] INCANDESCENT LIGHT SOURCE WITH TRANSPARENT HEAT MIRROR

[75] Inventors: Luke Thorington, Easton, Pa.; Peter Walsh, Stirling, N.J.; Ronald Koo, Upper Montclair, N.J.; Wolfgang Thouret, Verona, N.J.

[73] Assignee: Duro-Test Corporation, North Bergen, N.J.

[21] Appl. No.: 781,355

[22] Filed: Mar. 25, 1977

[51] Int. Cl.[2] ..... H01K 1/14; H01K 1/32
[52] U.S. Cl. ..... 313/112; 313/114; 313/222; 313/315; 313/344; 350/1.7; 350/292; 350/293
[58] Field of Search ..... 313/110–115, 313/217, 219–222, 315, 344; 350/1.7, 288, 292, 293

[56] References Cited

U.S. PATENT DOCUMENTS

| | | | |
|---|---|---|---|
| 1,425,967 | 8/1922 | Hoffman | 313/220 X |
| 2,084,999 | 6/1937 | Birdseye | 313/344 X |
| 2,859,369 | 11/1958 | Williams et al. | 313/113 |
| 3,209,188 | 9/1965 | Freeman | 313/110 X |

FOREIGN PATENT DOCUMENTS

| | | |
|---|---|---|
| 452127 | 5/1935 | United Kingdom. |
| 703127 | 1/1954 | United Kingdom. |
| 834087 | 5/1960 | United Kingdom. |
| 1017828 | 1/1966 | United Kingdom. |
| 1463939 | 2/1977 | United Kingdom. |

OTHER PUBLICATIONS

Fan et al., "Transparent Heat Mirrors for Solar-Energy Applications," Applied Optics, vol. 15, No. 4, Apr. 1976, pp. 1012–1017.

*Primary Examiner*—Siegfried H. Grimm
*Attorney, Agent, or Firm*—Darby & Darby

[57] ABSTRACT

An incandescent lamp having a transparent heat mirror placed on the lamp envelope which transmits a substantial portion of the energy in the visible range produced by the lamp filament and which reflects back to the filament at least about 80%–85% of the infrared energy that the filament produces. In the preferred embodiment the transparent heat mirror is formed by a layered coating of $TiO_2/Ag/TiO_2$ optimized for the operating temperature range of the filament. The filament is constructed to optically conform to the shape of the lamp envelope.

33 Claims, 5 Drawing Figures

INCANDESCENT LIGHT SOURCE WITH TRANSPARENT HEAT MIRROR

Attempts have been made to improve the efficiency of an incandescent lamp. A typical incandescent lamp using argon or nitrogen or an argon-nitrogen combination as the fill gas and a tungsten filament has an efficiency in the order of 17 lumens of light per watt of power input. This efficiency can be improved somewhat, for example, by changing the argon fill gas to krypton.

In the past, attempts have been made to improve lamp efficiency by reflecting as much of the infrared energy produced by the tungsten filament back to the filament while permitting the energy in the visible range produced by the filament to pass through the envelope. Typical of such attempts are, for example, U.S. Pat. No. 2,859,369 to Williams et al. In many cases, a specific lamp envelope geometry is used, for example, the envelope is of spherical shape. In further attempts to increase the efficiency of the light output, coatings have been used on the interior and/or exterior of the lamp envelope. For example, in an article by Frank J. Studer and D. A. Cusano appearing in the Journal of the Optical Society of America, Volume 43, No. 6 in June, 1953, a lamp is disclosed in which a titanium dioxide ($TiO_2$) coating is used on the interior and the exterior of the lamp envelope with a more-or-less conventional filament, i.e. a tungsten coiled-coil filament. The coating was placed on both the interior and exterior of a three-inch spherical lamp bulb and an elaborate mechanism was used to properly locate the filament at the optical center of the envelope to maximize the reflection of the infrared energy. This arrangement succeeded in increasing the light output efficiency of the lamp by about 7–10% percent.

The present invention also relates to an incandescent lamp in which envelope geometry, filament geometry and a reflective coating are utilized in a predetermined relationship to reflect the infrared (IR) energy and to transmit the visible energy produced by a tungsten filament to improve the overall lamp efficiency. The coating utilized in the invention is called a transparent heat mirror since it will reflect infrared (IR) energy while being transparent to visible light energy. The coating comprises a high conductivity metallic layer which is sandwiched between transparent dielectric layers whose index of refraction of light energy in the visible range substantially matches the index of absorption (imaginary part of the refractive index) of the metal. The metal is highly conductive and reflects the IR energy but its thickness is thin enough to pass the energy in the visible range. The dielectric layers provide phase matching and anti-reflection properties. In the preferred embodiment of the invention a three layer coating is used which is formed of films of titanium dioxide/silver/titanium dioxide ($TiO_2/Ag/TiO_2$). The transparent heat mirror coatings have a greatly increased efficiency in the reflection of IR energy and the transmission of visible light energy as compared, for example, to the titanium dioxide coating used by Studer and Cusano. While such coatings are relatively costly, when compared with the average cost of parts for the manufacture of a standard incandescent lamp, the increase in efficiency justifies the use of the coating.

As further features of the invention, a filament design is used to produce a radiation pattern of energy which as closely as possible conforms to the shape of the lamp envelope, which serves as the reflector. In addition, where the envelope is of substantially spherical shape, a mirrored member is placed between the neck of the envelope and the filament to reflect energy back to the filament and thereby reduce losses.

It is therefore an object of the present invention to provide an improved incandescent lamp.

A further object is to provide an improved incandescent lamp utilizing a layered coating on the lamp envelope which is efficient in reflecting infrared energy back to the filament and in transmitting visible energy.

Another object is to provide an improved incandescent lamp utilizing a transparent heat mirror on the envelope formed by a layered coating which is optimized for a given operating temperature range of the filament.

An additional object is to provide an improved incandescent lamp utilizing a mirrored envelope surface which is made as highly reflective as possible for infrared radiation.

An additional object is to provide an improved incandescent lamp utilizing a multilayer coating of films of $TiO_2/Ag/TiO_2$ on the envelope to form a transparent heat mirror.

Still a further object is to provide an incandescent lamp envelope with a transparent heat mirror and utilizing a filament design to maximize the probability that the energy reflected by the mirror will be intercepted by the filament.

A further object is to provide an incandescent lamp having a spherical envelope and a necked base portion with an IR reflective coating being placed on the spherical portion to reflect IR energy back to the filament and a mirror element located in the neck portion also to reflect IR energy back to the filament.

Other objects and advantages of the present invention will become more apparent upon reference to the following specification and annexed drawings, in which.

Figure 1:
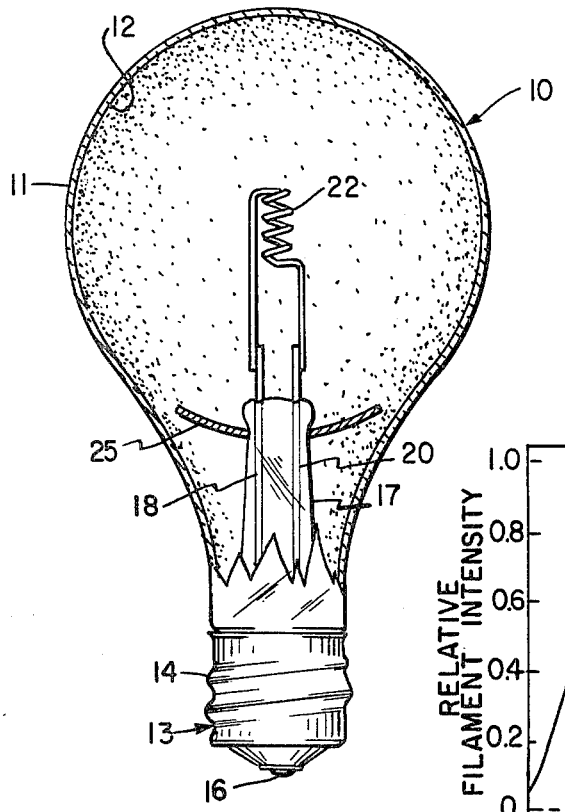
FIG. 1 is a view, shown partly broken away, of an incandescent lamp made in accordance with the subject invention.

Referring to the drawings, an incandescent lamp 10 is shown which has the usual base 13 with threaded contacts 14 and the bottom button contact 16. A stem 17 is attached to the interior of the base through which the sealing takes place. A pair of lead-in wires 18 and 20 pass through the stem and one end of each of these wires makes contact with the base contacts 14 and 16.

A filament 22 is mounted on the stem. The filament 22 shown in FIG. 1 is of tungsten wire which can be doped, if desired. However, the filament is preferably designed to have a shape such as will conform to the geometry of the envelope. That is, the filament is shaped with respect to the lamp envelope, which serves as a reflector surface, so that there will be an optimization of the possibility of interception by the filament of that portion of its energy reflected by the envelope. This is discussed in greater detail below. The filament 22 is shown vertically mounted by the supports 23, 24 which are connected to the lead in wires 18 and 20. Other filament mountings can be used.

As shown in FIG. 1, a generally spherical envelope 11 is provided, the envelope being non-spherical at its bottom end where the stem 17 is located. In its spherical portion the envelope is made as optically perfect as possible. That is, it is made smooth and with a constant radius of curvature so that if the filament is located at the optical center of the envelope, there can be substantially total reflection of mostly IR energy from the envelope wall back to the filament, assuming the envelope is capable of reflecting the energy. It is preferred that the filament be optically centered as close as possible within the spherical part of the envelope.

A transparent heat mirror coating 12 is placed on envelope 11. In the preferred embodiment of the invention, coating 12 is a multilayer coating of different materials which are described in greater detail below. It is preferred that all of the layers of the coating 12 be located on the interior of the envelope since this gives them the greatest degree of protection. However, a properly designed layered coating may be located on the exterior of the envelope in addition to or in place of a coating on the interior of the envelope.

The general requirements of the transparent heat mirror coating is that it pass, or transmit, as large an amount of the energy in the visible range produced by the filament as possible and that it reflect as much of the IR energy produced by the filament as possible back to the filament. As described in the prior art article by Studer and Cusano, reflection of IR energy back to the filament increases its temperature at constant power or maintains its temperature at a reduced power level thereby increasing the efficiency of the filament. This improves the lumens per watt efficiency of the lamp.

In accordance with the preferred embodiment of the invention, the transmissivity of the coating 12 to the average of visible energy over its range (i.e. from about 400 nanometers to about 700 nanometers) is at least about 60% and the reflectivity of the coating to the average IR energy (i.e. above about 700 nm) should average above 80%–85%. The ratio of average transmissivity in the visible range to average transmissivity in the IR range (l-reflectivity) should therefore be at least about 60%/15% or 4:1. The visible light spectrum produced by an incandescent filament operating at about 2900° K. is shown superimposed on the graph of FIG. 2A.

The characteristics of an ideal heat mirror are that all energy in the visible range be transmitted and that all energy in the IR range be reflected. Theoretically, the break point between transmittance and reflectance should occur at about 700 nanometers. That is, energy below 700 nanometers should be transmitted through the envelope and energy above 700 nanometers should be reflected. In practice, break points up to 850 nanometers and even somewhat higher can be tolerated. A graph showing the transmission characteristics of a preferred coating is shown in FIG. 2A.

As indicated above, the preferred coating is formed of a layer of metal sandwiched between two layers of dielectric material. A particularly effective coating has been found to be a layered coating of $TiO_2/Ag/TiO_2$. This coating is preferably deposited on the interior of the spherical envelope 11 of the lamp. The general principles of a layered coating of this type are described in an article entitled "Transparent Heat Mirrors For Solar-Energy Applications" by John C. C. Fan and Frank J. Bachner, at pages 1012–1017 of Applied Optics, Vol. 15, No. 4, April 1976. In that article, the $TiO_2/Ag/TiO_2$ coating is used on the undersurface of a glass flat plate reflector which is located above a solar absorber. The incident solar energy passes through the glass and the coating to the absorber. The IR from the heater absorber is reflected back to the absorber.

Figure 2:
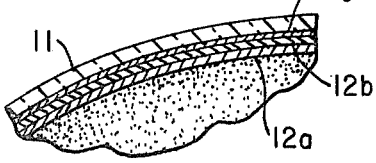
FIG. 2 is a fragmentary view in cross-section of a preferred form of coating in accordance with the invention.
Figure 2A:
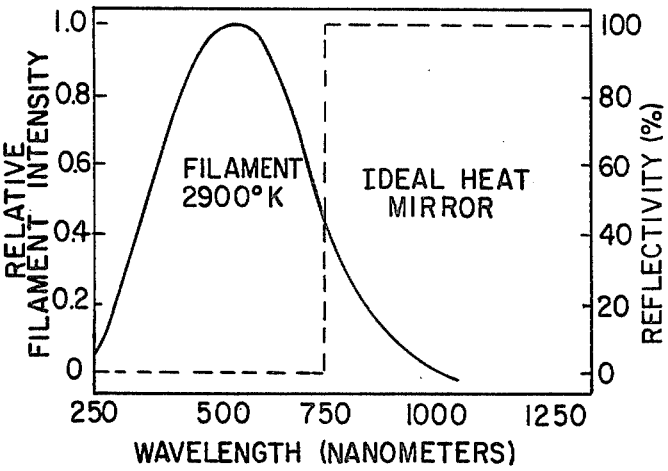
FIG. 2A is a graph of the characteristics of a preferred coating.

In accordance with the subject invention and as shown in FIG. 2, the envelope 11 is preferably of conventional glass used for lamp envelopes, i.e. "lime" glass. Any other suitable glass can be used. The layers of the coating are designated **12*a* for the first $TiO_2$ layer closest to the filament, 12*b* for the layer of silver, and 12*c*** for the $TiO_2$ layer most remote from the filament, and are deposited sequentially on the interior of the glass. This can be done, for example, by RF sputtering in an inert gas atmosphere such as argon. The layers of the coating also can be developed by other conventional techniques, involving dipping, spraying, vapor deposition, chemical deposition, etc. In all cases, adequate control of the thickness of each of the layers should be maintained so that each layer can be of the desired thickness.

In the preferred three layer $TiO_2/Ag/TiO_2$ mirror desired, the middle layer of silver **12*b*, provides the transparency to the visible energy and reflects IR energy. A thin layer of silver of about 20 nm. absorbs only about 10% or less of incident energy in the visible wavelength range. The titanium dioxide layers likewise transmit visible light and also serve as antireflection and phase matching layers. That is, the inner layer 12*a* closest to the filament, matches the phase of the visible energy to the layer of silver 12*b* which acts to reflect IR energy but transmits visible light. The outer layer 12*c*** then matches the phase of the transmitted visible energy to the glass for final transmission of the envelope with little visible reflections.

The thickness of the layers of coating 12 are selected to optimize the transmission of the visible energy and the reflection of the IR energy produced by the incandescent filament at its operating temperature. This is in the range of from about 2600° K. to about 2900° K. The operating temperature of the lamp is generally selected for lamp life and other considerations. For a short life lamp, one that has a rated life of about 750 hours, the filament operating temperature is about 2900° K. For an extended life lamp, one which operates in excess of 2000–2500 hours, the operating temperature is about 2750° K. The color temperature is generally about 50° K. lower.

The silver coating is optimized to increase the transmissivity to visible energy. It can be shown (see below) that the thickness of the inner and outer layers **12*a* and 12*c* of $TiO_2$ can be either in the ratio of 1:1 or 1:3, i.e. the $TiO_2$ layer 12*c* furthest from the filament is three times thicker than the inner layer 12*a*, i.e. the one closest to the filament. In a 1:1 coating, a layer of silver of about 20 nanometers has been found to be efficient over the filament operating temperature range of about 2600° K. to about 2900° K. for inner (12*a*) and outer (12*c***) $TiO_2$ coatings 18 nanometers thick. In a 1:3 ratio coating, an effective coating is a layer of silver 6 nanometers thick with an outer $TiO_2$ layer of 60 nanometers and an inner layer of 20 nanometers.

The range of the coating layers for an effective transparent heat mirror in accordance with the incandescent lamps of the subject invention, which is capable of reflecting at least about 80%–85% of the IR energy produced and transmitting at least 60% of the visible energy, is as follows:

| | 1:1 | 1:3 |
|---|---|---|
| $TiO_2$ layer 12a - | 13 to 28 nanometers | 13 to 28 nanometers |
| Ag layer 12b - | 13 to 28 nanometers | 4 to 9 nanometers |
| $TiO_2$ layer 12c - | 13 to 28 nanometers | 39 to 84 nanometers |

Coatings other than the preferred $TiO_2$/Ag/TiO combination can be used. Also, dielectrics other than $TiO_2$ can be used.

As indicated previously, the main criterion for the selection of the components of the layers of the coating is that the index of absorption of light energy of the dielectric layer ($\eta$) matches that of the metal ($\kappa$) near in the range of wavelengths ($\lambda\rho$) being considered. Some matching metals and dielectrics are:

| Dielectric | $\eta$ | Metal | $\kappa$ |
|---|---|---|---|
| $TiO_2$ | 2.6 | Sodium | 2.6 |
| Zn S | 2.3 | | |
| Cd S | 2.5 | | |
| $TiO_2$ | 2.6 | Silver | 3.6 |
| Glass | 1.5 | Potassium | 1.5 |
| Mg F | 1.5 | | |
| Na F | 1.3 | Rubidium | 1.2 |
| Li F | 1.4 | | |
| Glass | 1.5 | | |
| $TiO_2$ | 2.6 | Gold | 2.8 |

Other characteristics also must be considered, the principal one being the transmissivity to visible light of the metal.

It can be mathematically shown that the dielectric and metal films have either of the following thickness combinations $$l_1 = \rho_3 = \lambda\rho/8\eta \text{ : dielectrics} \quad (1)$$

$$l_2 = \frac{\lambda\rho}{2\pi}\ \frac{1}{\kappa}\ \text{arc tanh}\left\{\frac{\eta^2 - \eta_0\eta_3}{\eta^2 + \eta_0\eta_3}\right\}\text{: metal}$$

$$\left.\begin{array}{l} l_1 = \lambda\rho/8\eta, \\ l_3 = 3\lambda\rho/8\eta, \end{array}\right\}\text{: dielectrics} \quad (2)$$

$$l_2 = \frac{\lambda\rho}{2\pi}\ \frac{1}{\kappa}\ \text{arc tanh}\left\{\frac{\eta_3 - \eta_0}{\eta_3 + \eta_0}\right\}\text{: metal}$$

where:

$\eta_0$=index of the gas in the envelope, which is substantially unity $\eta_3$=index of the glass envelope $l_1$ is the thickness in nanometers of the dielectric layer closest to the filament $l_2$ is the thickness in nanometers of the metal layer $l_3$ is the thickness in nanometers of the dielectric layer furthest from the filament.

The fill gas for the envelope can be selected in accordance with standard design criteria for filament life, decrease in energy consumption, etc. Thus, a conventional argon fill gas, krypton fill gas, or vacuum can be utilized. Other conventional fill gases or mixtures thereof also can be used.

Where a spherical envelope is used, a curved reflecting shield 25 is preferably placed in the neck portion of the envelope to provide reflection of energy from that area of the envelope back to the filament. Shield 25 is of a reflective metal material and it can be mounted on stem 17. Any suitable mounting means can be used. A reasonably good reflector is aluminum. A better reflector is silver or gold. Shield 25 can be of the same radius of curvature as the spherical portion of the envelope and located in the envelope neck at a position to close the sphere and to reflect energy back to the filament. By suitable design of its radius of curvature, shield 25 can be located at a different position, closer to the filament, and still reflect energy back to the filament.

It has been determined that the most critical aspects of an incandescent lamp using a heat mirror are the mirror itself, that is, how effective it is as an IR reflector and visible light transmitter, and the design (geometry) and centering of the filament. While filament centering is important, it has been determined that with a proper filament geometry for a given shape envelope (reflector) a substantial increase in lumens per watt output of the lamp can be produced where the IR reflectivity of the mirror exceeds 45%–50%, even where the filament is off the optical axis of the envelope by as much as one-half the diameter of the filament.

To optimize the efficiency of the lamp, the filament should preferably have a geometry conforming to that of the envelope and it should be located at the optical center of the envelope. For example, in a spherical envelope, the filament ideally should be spherical and located at the optical center of the envelope. With these two conditions satisfied, the filament will be optically situated such that, theoretically, all energy reflected from the envelope will impinge back, on to the filament.

Practically, it is not possible to make a filament whose geometry completely conforms to that of a spherical envelope. For example, the manufacture of a spherical filament from tungsten wire presents many practical difficulties.

Because of this, several compromises are made. First, the filament geometry is made as closely conforming as possible to the envelope geometry. Second, the filament is made with a relatively closed configuration. That is, the filament is made closed so that only a minimum amount of infrared energy reflected from within the envelope coating from any direction will pass through the filament to the opposite wall without being absorbed by the filament. In the preferred embodiment, the openess of the filament is such that on the average less than about 50% of the reflective light will pass directly through the filament with a preferred openess being below about 40%. That is, 60% or more of the reflected IR energy will be absorbed by the filament.

Figure 3:
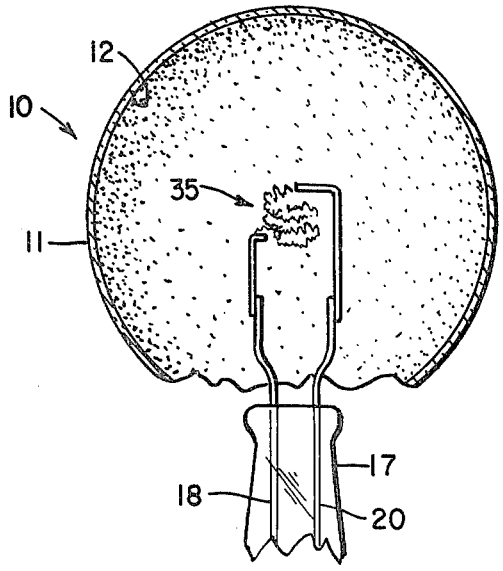
FIG. 3 is an elevation view of a preferred form of filament used with the invention.

FIG. 3 shows a form of filament which is usable with the lamp of the subject invention. The object of the filament design is to produce a filament having the effect of a sphere within the confines imposed by conventional filament materials and manufacturing techniques. A cylindrical shaped filament provides a fairly efficient radiator and, also, operates fairly effectively even when the longitudinal axis of the cylinder is displaced from the optical center of the envelope.

The filament 35 of FIG. 3 is made of conventional filament material, e.g. tungsten wire which can be doped as desired to improve operation. These dopings are conventional and, in themselves, are not the subject of this invention. The filament of FIG. 3 is a triple coiled filament which also is called a coiled-coiled-coil filament.

The filament is formed by first making a conventional coiled-coil filament, that is by taking a tungsten wire, forming it into a helical coil and then making a further helical coil out of the coiled wire. A further helical coiling operation of the coiled coil filament is made to form the triple coiled filament. The triple coil is wound into a helix which has the general overall shape of a cylinder. The height and diameter of the cylinder are made approximately equal so that the cylinder approximates a sphere. The radius of the cylinder formed by the wire is preferably at least about one-fifth or less than the radius of the spherical section of the envelope. The "openess" is also preferably about 40% or less. Using the foregoing geometry and openess, the filament of FIG. 3 can be used in an envelope with a 40% efficient IR reflective coating and substantial improvement in efficiency will be obtained.

Figure 4:
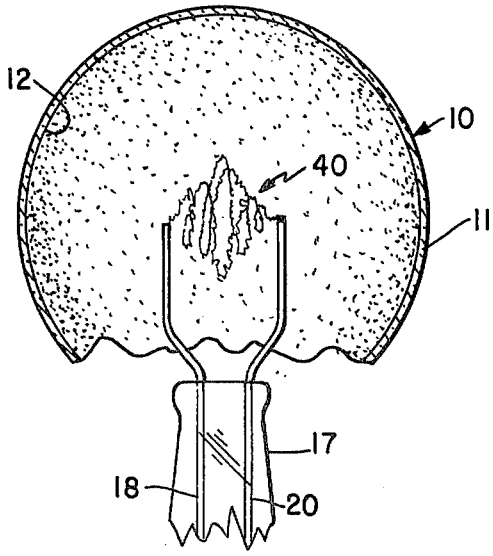
FIG. 4 is an elevation view of a further embodiment of filament.

FIG. 4 shows a further form of filament 40 whose outer surface roughly approximates a sphere. Here a triple-coiled filament wire is used again and wound so as to have tighter turns of the ends and wider turns at the center. A filament of this type has further advantages in that it more closely approximates the spherical shape of the lamp envelope and, therefore, is capable of being optically aligned more precisely.

While a spherical shaped envelope has been described, it should be understood that a suitably efficient transparent heat mirror will produce an efficient lamp with other shaped envelopes and suitable geometrically conforming filaments. For example, the envelope can be a cylinder with a cylindrical radiating source formed either of wire or a perforated cylindrical sleeve. The envelope may also be an ellipsod or a circular ellipse. In the latter cases, the filaments would preferably have the shapes needed to produce a radiation pattern conforming as closely as possible to that of the envelope. In the case of an envelope formed as an ellipsoid, two filaments can be used, one at each focus of the ellipsoid.

What is claimed is:

1. An incandescent electric lamp comprising:

an envelope, incandescent filament means within said envelope for producing upon incandescence energy in the visible and infrared range upon the application of electrical current thereto, means electrically connected to said filament means adapted for supplying electrical current thereto, said filament means being located with respect to the interior of the envelope and the major portion of said envelope being shaped with a curved surface such that infrared energy produced by said filament means upon incandescence and reaching the envelope can be reflected back toward said filament means, and a transparent heat mirror coating on a major portion of said envelope curved surface said envelope formed by a layer of a high conductivity metal which is thick enough to reflect infrared energy and thin enough to transmit visible energy and at least one layer of a dielectric material thereon whose index of refraction of the energy in the visible range substantially matches the index of absorption of the metal in the visible range, said coating for reflecting back towards the filament at least an average in excess of about 60% of the energy over the infrared range produced by said filament means and for transmitting therethrough an average in excess of about 60% of the energy over the visible range produced by said filament means which reaches said coating said dielectric material providing phase matching to the visible energy for the metal.

2. An incandescent electric lamp as in claim 1 wherein said coating is formed so that of the energy reaching it the ratio of transmission through said coating of the average of the energy over the visible light range produced by the filament to the transmission of the average of the energy over the infrared range produced by said filament is at least about 3 to 1.

3. An incandescent electric lamp as in claim 2 wherein said ratio is at least about 4 to 1.

4. An incandescent electric lamp as in claim 3 wherein said filament has an operating temperature in the range of from about 2600° K. to about 2900° K. and said coating is optimized for the transmission of visible and reflection of infrared energy in this temperature range.

5. An incandescent electric lamp as in claim 1 wherein said coating transmits therethrough at least about 60% of the average of the energy over the visible range reaching it and reflects back towards the filament at least about 80% to 85% of the average of the energy over the infrared range reaching it.

6. An incandescent electric lamp as in claim 1 wherein the metal is selected from the group consisting of silver, rubidium, sodium and potassium.

7. An incandescent electric lamp as in claim 1 wherein said coating comprises a layer of metal sandwiched between and contiguous with layers of dielectric material, each of said layers of dielectric material having an index of refraction of energy in the visible range which substantially matches the imaginary part of the reflective index of the metal.

8. An incandescent electric lamp as in claim 7 wherein said coating is formed so that of the energy reaching it the ratio of transmission through said coating of the average of the energy over the visible light range produced by the filament to the transmission of the average of the energy over the infrared range produced by said filament is at least about 3 to 1.

9. An incandescent electric lamp as in claim 8 wherein said ratio is at least about 4 to 1.

10. An incandescent electric lamp as in claim 7 wherein said coating transmits therethrough at least about 60% of the average of the energy over the visible range reaching it and reflects back towards the filament at least about 80% to 85% of the average of the energy over the infrared range reaching it.

11. An incandescent electric lamp as in claim 10 wherein the metal is selected from the group consisting of gold, silver, rubidium, sodium and potassium.

12. An incandescent electric lamp as in claim 7 wherein said layer of metal comprises silver and said layers of dielectric material each comprises titanium dioxide.

13. An incandescent electric lamp as in claim 12 wherein the ratio of the thickness of the layers of the dielectric materials is substantially 1 to 1.

14. An incandescent electric lamp as in claim 12 wherein the ratio of the thickness of the layer of the dielectric material closest to the filament to that furthest from the filament is substantially 1:3.

15. An incandescent electric lamp as in claim 12 wherein said filament has an operating temperature in the range of from about 2600° K. to about 2900° K. and said layers of the coating having the following thicknesses:

| | Thickness (in nanometers) from about | to about |
|---|---|---|
| inner layer of dielectric material closest to filament | 13 | 28 |
| layer of metal | 13 | 28 |
| outer layer of dielectric material | 13 | 28 |

16. An incandescent electric lamp as in claim 12 wherein said filament has an operating temperature in the range of from about 2600° K. to about 2900° K. and said layers of the coating having the following thicknesses:

| | Thickness (in nanometers) from about | to about |
|---|---|---|
| inner layer if dielectric material closest to filament | 13 | 28 |
| layer of metal | 4 | 9 |
| outer layer of dielectric material | 39 | 84 |

17. An incandescent electric lamp as in claim 7 wherein said filament has an operating temperature in the range from about 2600° K. to about 2900° K. and said coating is optimized for the transmission of visible and reflection of infrared energy in this temperature range.

18. An incandescent electric lamp as in claim 1 wherein said filament is constructed so that at least about 50% of the average of the energy in infrared range reflected from the envelope and the coating back toward the filament is incident onto said filament.

19. An incandescent electric lamp as in claim 18 wherein said filament is constructed so that at least about 60% of the average of the energy in infrared range reflected from the envelope and the coating back toward the filament is incident onto said filament.

20. An incandescent electric lamp as in claim 1 wherein said filament is formed of a wire which is triple coiled and physically formed to approximate the geometry of the reflecting portion of the envelope and being located substantially at the optical center of the reflecting portion of the envelope.

21. An incandescent electric lamp as in claim 20 wherein said filament is shaped to radiate a pattern of energy which substantially conforms to the shape of the surface of the reflecting portion of the envelope.

22. An incandescent electric lamp as in claim 21 wherein the reflecting portion of said envelope is generally cylindrical and said filament is also generally cylindrical.

23. An incandescent electric lamp as in claim 21 wherein the reflecting portion of said envelope is generally spherical and said filament is formed to physically approximate the shape of a sphere.

24. An incandescent lamp as in claim 1 wherein there is a layer of dielectric material on each side of said metal layer.

25. An incandescent lamp as in claim 24 wherein said coating reflects back toward said filament means at least an average in excess of about 80% of the energy over the infrared range above about 700 nm produced by the filament and transmits at least an average in excess of about 60% of the energy in the visible range between about 400 nm to about 700 nm.

26. An incandescent lamp as in claim 25 wherein said filament means operates upon incandescence in the temperature range of from about 2600° K. to about 2900° K.

27. An incandescent lamp as in claim 26 wherein the material of the dielectric layers in titanium dioxide and the metal layer is silver.

28. An incandescent lamp as in claim 24 wherein the thickness of each layer of the coating is one-tenth or less than the wavelength of the lowest wavelength visible light to be transmitted.

29. An incandescent electric lamp comprising a spherical shaped envelope with an elongated neck portion, an incandescent filament within said envelope for producing upon incandescence energy in the visible and infrared range upon application of electrical current thereto, means electrically connected to said filament adapted for supplying electrical current thereto, a coating on the spherical portion of the envelope for reflecting back to the filament at least a part of the infrared energy produced by said filament and for transmitting therethrough a substantial portion of the visible range energy produced by said filament, said reflector means adjacent said neck portion having substantially the same radius of curvature as the spherical portion of said envelope and located with respect to said envelope spherical portion to conform to its contour.

30. An incandescent electric lamp as in claim 29 wherein said reflector means is spaced from a continuation of the inner surface of the spherical portion of the envelope in the neck portion and has a radius of curvature to reflect the infrared energy back to the filament.

31. An incandescent electric lamp as in claim 29 wherein said reflector means includes a metallized surface having a metal thereon.

32. An incandescent electric lamp as in claim 31 wherein the metal of said metallized surface is selected from the group consisting of aluminum, silver and gold.

33. An incandescent electric lamp as in claim 29 wherein a stem is provided in the neck portion of the envelope on which said filament is mounted, and means for attaching said reflector means to said stem.

* * * * *